United States Patent [19]

White

[11] 4,446,987

[45] May 8, 1984

[54] VALVE ATTACHMENT FOR PRESSURIZED CONTAINERS

[76] Inventor: Kenneth R. White, 5144 E. 65th St., Indianapolis, Ind. 46220

[21] Appl. No.: 231,098

[22] Filed: Feb. 3, 1981

[51] Int. Cl.[3] ..... B67B 7/24

[52] U.S. Cl. ..... 222/89; 220/326; 215/287; 222/89

[58] Field of Search ..... 222/5, 89, 83, 567, 222/570, 3; 220/85 R, 319, 324, 326; 215/100 R, 287; 285/320, 319, 178; 81/3.4, 3.44; 294/103, 90

[56] References Cited

U.S. PATENT DOCUMENTS

| | | | |
|---|---|---|---|
| 1,164,553 | 12/1915 | Schnell | 215/287 |
| 1,761,157 | 6/1930 | Schellin | 285/34 |
| 1,920,524 | 8/1933 | Reed | 285/34 |
| 2,069,216 | 2/1937 | Clark | 285/170 |
| 2,565,269 | 8/1951 | Saxton | 220/324 |
| 2,770,474 | 11/1956 | Krapp | 251/149.6 |
| 2,875,777 | 3/1959 | Lacart | 137/318 |
| 2,893,603 | 7/1959 | Franck | 222/83 |
| 2,981,439 | 4/1961 | Huffman | 222/567 |
| 3,092,291 | 6/1963 | Franck | 222/83 |
| 3,155,402 | 11/1964 | Cornelius | 285/88 |
| 3,438,656 | 4/1969 | Fritch | 285/178 |
| 3,580,424 | 5/1971 | Philipps | 222/89 |

FOREIGN PATENT DOCUMENTS 554743 3/1958 Canada .

*Primary Examiner*—Kenneth W. Noland

[57] ABSTRACT

Mechanism for attaching a valve assembly to a pressurized container having a neck closed by a puncturable diaphragm and surrounded by a radially outwardly extending circumferential rim. The mechanism includes a body portion having a partial skirt with an inward arcuate lip to engage beneath one side of the circumferential rim of the container and a central upstanding boss which is internally threaded to receive the threaded stem of the valve assembly. A locking arm is pivotally received on the central boss and has a downwardly displaced inwardly extending lip to engage beneath the circumferential rim of the container. In the normal position of the locking arm, its lip is radially spaced less than 180° from an opposite end of the arcuate lip of the body to define an entrance opening for receiving the rim of the container therethrough. The locking arm is resiliently movable outward from the body, so that the mechanism can be manually forced edgewise over the container rim to carry the arm lip and opposite end of the arcuate lip past diametrically opposite positions on the container rim to lock the mechanism to the container. The locking arm can then be swung toward the opposite end of the arcuate lip to close the entrance and secure the attachment mechanism in place on the neck of the container.

13 Claims, 5 Drawing Figures

FIG. 1
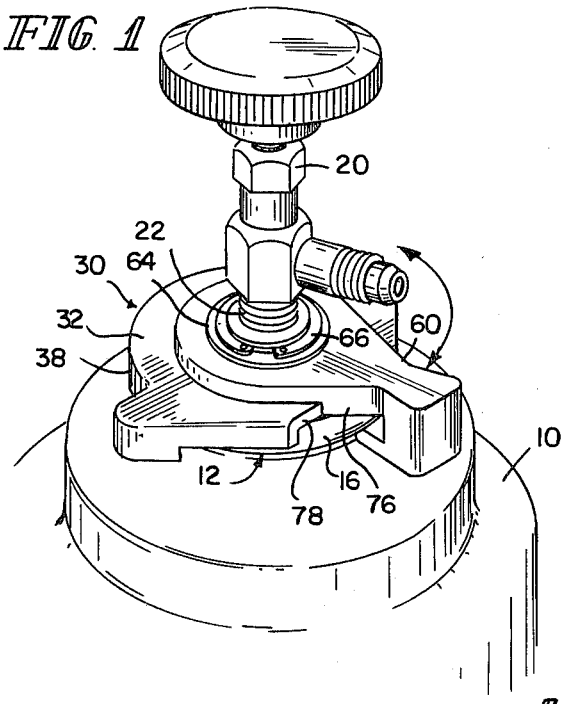
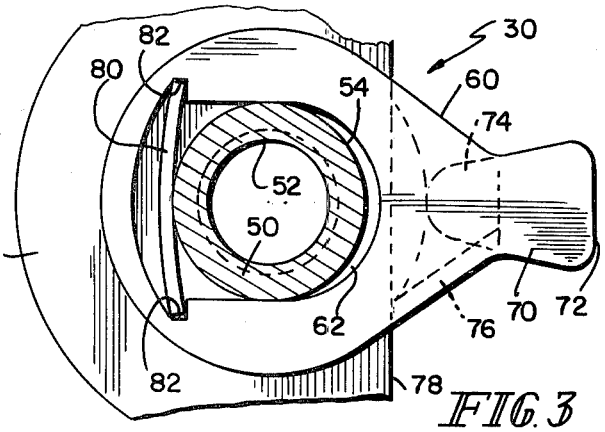
FIG. 3
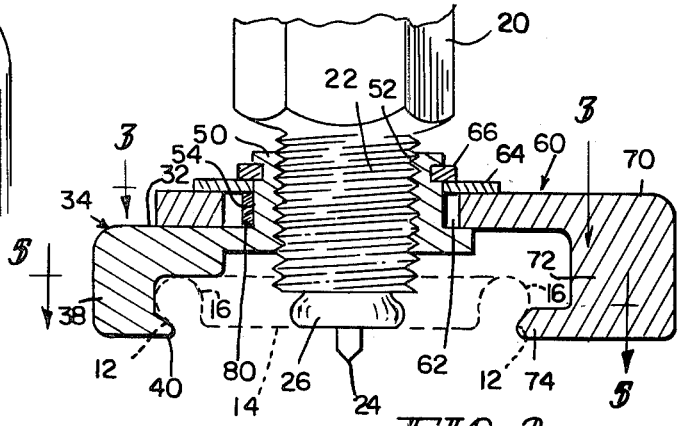
FIG. 2
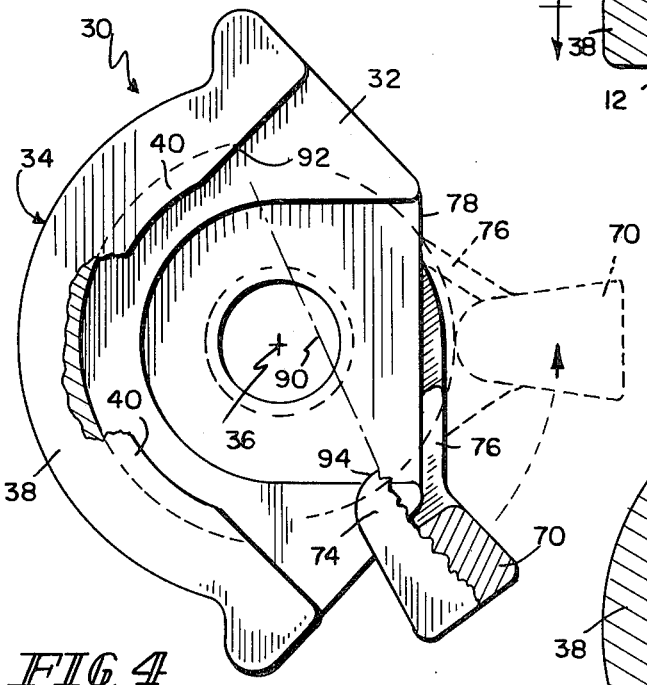
FIG. 4
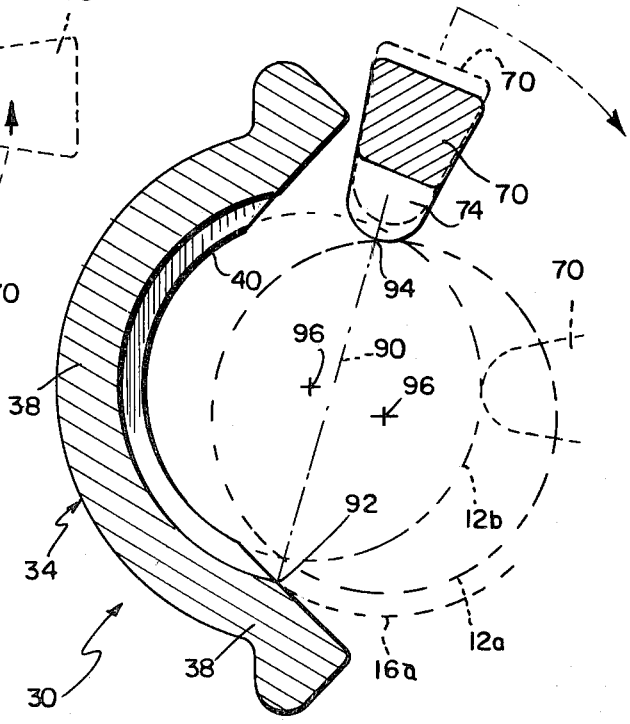
FIG. 5

VALVE ATTACHMENT FOR PRESSURIZED CONTAINERS

This invention relates to mechanisms for attaching a discharge valve assembly to a pressurized container, such as those used for containing a supply of Freon or other gases under pressure.

Standard cans of this type have a neck portion closed by a puncturable diaphragm and surrounded by a radially outwardly extending circumferential lip or rim. The attachment mechanism is adapted to connect to such container a valve assembly which can be threaded down into sealing engagement with the puncturable diaphragm and which contains a puncturing or piercing element to open the container. The valve assembly is connected to the container for controllably dispensing the pressurized gas. A number of clamps for this purpose are known. In particular, U.S. Pat. No. 3,438,656 shows a clamp in which the central boss on the body has an eccentric outer surface, and a clamping arm is pivoted on that surface so as to swing into and out of clamping engagement with the container rim when the body portion is mounted on the neck. The arrangement is such that the clamping arm makes progressively increasing engagement with the container neck as it is swung toward a clamping position. The clamping force can generate such excessive stress on the clamping arm that breakage may occur.

It is the object of the present invention to provide a valve attachment mechanism which is easily attached to a pressurized container and is securely held in place, but which does not employ an eccentrically mounted clamping lever and in which stress on the parts is limited so as to avoid the breakage which occurs with the clamp of U.S. Pat. No. 3,438,656.

In accordance with the invention, the attachment mechanism comprises a body having a depending arcuate skirt with a downwardly offset, inwardly extending arcuate lip means to engage the neck of the container and beneath the circumferential rim of the container at a plurality of points about one side of the container neck. The skirt and lip means each extend over an arc of somewhat less than 180°, and may be discontinuous. The body also has a central upstanding boss with a threaded inner surface for the reception of the valve stem and with an outer surface which is concentric with the arcuate skirt and lip means. A locking arm is mounted on the body and engages the concentric outer surface of the boss. The arm carries a downwardly offset, inwardly extending lip at its free end adapted to engage beneath the circumferential rim of the container. Means is provided for yieldingly biasing the lip of the locking arm inward toward the center of the body and its boss. The biasing means allows the lip to move resiliently outward to lock and unlock the mechanism on the container.

The locking arm has a normal position in which its lip lies near one end of the arcuate body lip means and almost diametrically opposite from the other end thereof so as to define an opening through which the neck of the container can be moved edgewise to a position concentric with the attachment body. In such normal position, the circumferential spacing between the lip of the arm and the opposed end of the body lip means is desirably less than 180° so that it is necessary for the arm lip to move resiliently outward as the attachment mechanism is engaged over the neck of the container. The outward movement of the arm lip allows the attachment mechanism to move past a center line as it is mounted on the container. As the opposite lip portions move past the center line, the bias on the arm moves its lip inward toward the body to lock the attachment mechanism to the container.

After the mechanism has thus been locked on the container, the locking arm can be substantially freely swung to a position opposite to the skirt of the body and where it is substantially equiangularly spaced from the two ends of the arcuate body lip means so that it blocks the entrance and prevents unlocking and removal of the mechanism from the container until the arm is moved back to its normal position where its lip can retract against the bias to permit the neck to be again moved manually across the center line to separate the mechanism from the container.

The resilient biasing means for biasing the locking arm lip inward is desirably provided by forming the arm with an elongated opening for receiving the boss of the body, and mounting a leaf spring across one end of such opening so that the spring bears against the central boss of the body and biases the locking arm as a whole inward toward the axis of the body and its central boss.

The accompanying drawings illustrate the invention and show an embodiment exemplifying the best mode of carrying out the invention as presently perceived. In such drawings:

FIG. 1 is a perspective view of a valve attachment mechanism embodying the present invention shown in attached and locked position on the neck of a pressurized container;

FIG. 2 is an enlarged cross-sectional view of the mechanism of FIG. 1 shown in a fully locked position;

FIG. 3 is a top plan view, partially cross-sectioned, of the mechanism of FIGS. 1 and 2 shown in the fully locked position, taken generally along section line 3—3 of FIG. 2;

FIG. 4 is a bottom plan view, partially cross-sectioned, of the mechanism of FIGS. 1 and 2, showing two positions of the locking arm of the mechanism; and FIG. 5 is a cross sectional view of the mechanism of FIGS. 1 and 2, taken generally along sections line 5—5 of FIG. 2 and diagrammatically illustrating the operation of attaching the mechanism to the neck of a container.

Referring to FIGS. 1 and 2, the present invention is concerned with containers 10 which contain a supply of pressurized gas, for example, Freon, and valve assemblies 20 employed to controllably dispense the pressurized gas from the container 10. These containers 10 generally include a neck portion 12 which is closed by a puncturable diaphragm 14 to contain the gas in the container 10 under pressure. Typically, a circumferential rim 16 extends radially outwardly around the periphery of the neck portion 12.

The valve assembly 20 is attached to the container 10 by an attachment mechanism 30 which is connected to neck portion 12 and rim 16 of the container 10. Typically, the valve assembly 20 has a threaded valve stem 22 which is threaded into the attachment mechanism. As particularly shown in FIG. 3, the valve stem 22 includes a puncturing or piercing element 24 and a resilient sealing member 26 for opening the container 10 and sealing the valve assembly 20 to the container 10 as the assembly 20 is threaded into the mechanism 30.

Various valve assembly attachment mechanisms are known in the art. The present invention relates to improvements which avoid problems associated with some of the prior valve attachment mechanisms.

Referring now to FIGS. 1-5, the valve attachment mechanism 30 of the present invention includes a body portion 32 having a top wall 33 and an outer arcuate edge 34 formed about the center 36 of the body portion 32, as best shown in FIG. 4. A skirt 38 depends from the arcuate edge 34. A radially inward extending arcuate lip means 40 is formed on the skirt 38 and is offset downward from the top wall 33. The lip means 40 is adapted to be received beneath the circumferential rim 16 of the container 10. The arcuate lip means 40 also extends on an arc about the center 36, and is adapted to engage beneath the rim of the container neck at a plurality of points about an arc of less than 180°.

A generally cylindrical boss 50 extends upwardly from the body 32 and preferably has a center corresponding to the center 36 of the arcs of edge 34 and lip means 40. The cylindrical boss 50 includes a threaded inner surface 52 for receiving the threaded valve stem 22 of the valve assembly 20. The boss 50 further includes an outer surface 54 which is concentric with its inner surface 52 and with the skirt 38 and lip means 40 of the body 32.

A pivotal locking arm 60 is mounted on the central boss 50 of the body 32. This is formed with a pivot opening 62 which is received over the cylindrical boss 50. The locking arm 60 is retained on the boss 50 by a washer 64 and a snap ring 66 or the like.

The locking arm 60 extends radially outward and carries a finger piece 70 at its end, forming a hook-shaped end portion 72. A downwardly offset, radially inwardly extending lip 74 is formed on the end portion 72 and is adapted to be received beneath the circumferential rim 16 of the container 10 opposite the skirt 38 and lip means 40 of the body portion 32 to lock the attachment mechanism 30 onto the container 10. As best shown in FIG. 4, a blocking rib 76 is formed on the locking arm 60 adjacent the finger piece 70 to limit pivotal movement of the locking arm by engaging an edge 78 opposite from the arcuate edge 34 of the body 32.

Means is provided for yieldably biasing the lip 74 of the finger 70 inward toward the center 36 of the body portion 32 and boss 50, a preferred embodiment of which is particularly shown in FIGS. 2 and 3. In such embodiment, the pivotal opening 62 in the locking arm 60 is formed as an elongated, U-shaped opening with side notches 82 at its rear end, and a resilient leaf spring 80 is mounted in such notches in position to bear against the outer surface 54 of the boss 50 in a direction to bias the arm 60 as a whole radially inward toward such boss. The biasing means allows the lip 74 to move radially outward to lock and unlock the mechanism 30 on the container 10 in a manner which will be explained in the description of the operation of mechanism 30.

The operation of the attachment mechanism 30 can best be described by referring to FIGS. 4 and 5 where the locking arm 60 and its finger piece 70 are shown by solid lines in their normal position and by broken lines in their secured lock position.

As shown in the bottom view of FIG. 4, when the arm 60 is in its normal or open position, the blocking rib 76 thereon lies in engagement with the edge 78 of the body 32 to position the tip 94 of the arm lip 74 at a point which is angularly spaced from the opposite end 92 of the arcuate body lip means 40 by an angle of a little less than 180° so as to define therebetween a lateral entrance opening of a width, along the line 90 in FIGS. 4 and 5, which is slightly less than the outside diameter of the neck 12 but through which the rim of the container can be entered by resilient outward movement of the arm lip 74.

As further shown in the sectional top view of FIG. 5, when the neck 12 of the container is first brought to the entrance opening between the arm lip 74 and the opposite end position of the skirt 38, as to the position 12*a* in FIG. 5, the edges of the neck 12 and its rim 16 engage such lip and skirt to stop movement through that entrance. However, moderate manual force on the neck will cause the arm 60 and its lip 74 to move resiliently outward to permit the neck to enter into a concentric position within the skirt, indicated by the position 12*b* in FIG. 5. As it does so, the diameter of the neck will pass across the line 90, and the lip 74 will move past a dead center position on the neck and inward to lock the neck in its centered position. As such force is exerted on the neck 12 to push it through the entrance opening formed by the lip means end 92 and tip 94 of the finger 74, the finger piece 74 will move radially outwardly against the bias of the spring 80, as shown in FIG. 5. As long as the center 96 of the neck 12 is outside of the center line 90 (i.e., to the right of the center line 90 in FIG. 5), the mechanism 30 remains unlocked on the container 10. When the center 96 is forced past the center line 90 to the inside (i.e., to the left of the center line 90 in FIG. 5), the lip 94 is urged inwardly to lock the mechanism 30 on the container 10.

After the mechanism 30 is locked on the container 10, the locking arm 60 can be pivoted in the direction, as indicated by the dotted arrows in FIGS. 4 and 5, to a secured lock position where the finger 70 is substantially equiangularly spaced from both ends of the lip means 40. Blocking rib 76 then engages the opposite end of the edge 78, as shown in dotted lines in FIG. 4, to limit pivotal movement of the arm 60 so that finger 70 is thus equiangularly spaced from the ends of the lip region 40. The arm 60 is pivotally movable from its normal position to its secured lock position and vice versa with little force being exerted on the finger 70 of the arm 60. Such movement is essentially an arcuate pivotal movement about the common center of the body 32 and the container neck 12, and not a camming movement such as to exert increasing stress on the parts.

Locking and unlocking of the mechanism 30 both occur with the finger 70 in its normal position. The force required to lock and unlock the mechanism 30 on the container is exerted against the spring 80 as the center 96 of the neck portion 12 passes the center line 90. When the center 96 is on either side of the center line 90, the finger 70 is biased inwardly toward the center 36 and engages the neck portion 12 beneath the circumferential rim 16 with a force which is limited by the resilience of the spring 80. This, in turn, limits the stress on the locking arm 60 and the finger 70. Pivotal movement of the arm 60 to its secured lock position merely serves to prevent the unlocking of the mechanism 30, and while the force exerted on the finger 70 during the pivotal movement of the arm 60 may vary to some extent by reason of tolerance variations in the size and shape of the neck, such force will normally remain relatively constant and will always be limited by the resilience of the spring.

What is claimed is:

1. Mechanism for attaching a valve assembly to the neck of a container having a circular peripheral rim, comprising an attachment body having means for supporting said valve assembly for the container, lip means on said body for engaging the container neck and beneath the rim thereof at a plurality of points over an arc of less than 180° for holding the body on the neck, a locking arm pivotally movable about an axis substantially on the center of such arc and carrying a lip adapted to engage the neck of the container and beneath the rim thereof at a point opposite to said body lip means to lock the body to the container, said arm lip being movable radially of said axis between a rim-engaging position and a retracted position, means for resiliently biasing the arm lip inward toward such rim-engaging position for resiliently engaging the neck with limited force, said arm having a normal open position in which said arm lip is angularly spaced from said body lip means sufficiently to define a side entrance opening through which the rim of the container neck may be manually entered into engagement with the body lip means, said arm being pivotally movable from such normal position to a position opposite the body lip means, in which position the arm lip engages the neck with the limited resilient force exerted thereon by said biasing means to secure the mechanism in place on the container neck.

2. Mechanism for attaching a valve assembly to the neck of a container having a circular peripheral rim, comprising an attachment body having means for supporting said valve assembly for the container, lip means on said body for engaging the container neck and beneath the rim thereof at a plurality of points over an arc of less than 180° for holding the body on the neck, a locking arm pivotally movable about an axis substantially on the center of such arc and carrying a lip adapted to engage the neck of the container and beneath the rim thereof at a point opposite to said body lip means to lock the body to the container, a spring acting between the arm and its pivot support in a direction to bias the arm as a whole inwardly toward such pivot support so as to bias the arm lip into resilient engagement with the neck, said arm having a normal open position in which said arm lip is angularly spaced from said body lip means sufficiently to define a side entrance opening through which the rim of the container neck may be manually entered to a position substantially concentric with the pivotal axis of the arm, said arm being pivotally movable from such normal position to a position opposite the body lip means, in which position the arm lip engages the neck with resilient force to secure the mechanism in place on the container neck.

3. The mechanism of claim 2 wherein the arm lip is spaced angularly from the body lip means at an angle generally less than 180° to define the side entrance opening.

4. The mechanism of claim 3 wherein the means for supporting the valve assembly includes an upstanding boss, the locking arm including an elongated opening for receiving the boss, and the biasing means including a leaf spring captured in the elongated opening and bearing against an outer surface of the boss.

5. An attachment mechanism for connecting a valve assembly to a container having a peripheral rim, comprising a body, an arcuate skirt depending from the body, a cylindrical boss extending upward from the body and adapted to receive the valve assembly, said boss having an outer surface substantially concentric with the arcuate skirt, the skirt including a radially inwardly extending lip means adapted to be received beneath the rim of the container, a locking arm pivotally received on the boss and pivotably movable about an axis, the arm including a downwardly extending end portion and a radially inwardly extending lip adapted to be received beneath the rim of the container, said arm lip being movable radially of said axis between a rim-engaging position and a retracted position, and means for yieldably biasing the lip of the arm toward its rim-engaging position, the arm having a normal position in which the arm lip is located at a distance less than the diameter of the container rim from an opposite end portion of the skirt lip so as to define therewith a restricted entrance for movement of the container rim into engagement with the skirt lip, the arm lip in such location being resiliently retractable to permit a container rim to be manually moved through such restricted entrance into engagement with the lip means and being operative thereafter to hold the rim in such engagement.

6. The mechanism of claim 5 wherein the locking arm is pivotally movable from said normal position to a locking position opposite a mid-portion of said skirt lip so as to lock the container rim to the attachment, the arm lip in such locking position of the arm being biased toward engagement with the rim and retractable therefrom against said biasing means so as to limit the force of its engagement with the rim to that produced by the biasing means.

7. The mechanism of claim 5 wherein the locking arm includes an opening for pivotally receiving the boss and the biasing means includes a leaf spring captured in the opening and bearing against the outer surface of the boss.

8. The mechanism of claim 5 in which the arm is movable from its said normal position to a locking position, with the addition of stop means for stopping the arm in its normal position upon return movement from its locking position, so that the container is not released from the attachment until manually moved out through said entrance.

9. The mechanism of claim 6 with the addition of stop means for stopping the arm in its normal position upon return movement from its locking position, so that the container is not released from the attachment until manually moved out through said entrance.

10. Mechanism for attaching a valve assembly to the neck of a container having a circular peripheral rim, comprising an attachment body having means for supporting a valve assembly for the container, lip means on said body for engaging the container rim at a plurality of points over an arc of less than 180° for positioning the body on the neck, a locking arm on said body and carrying a lip movable with the arm and substantially in the plane of the body lip means between an assembly position for permitting a container rim to be moved into engagement with the body lip means, and a locking position opposite the body lip means for locking the body to the container, said arm lip in its locking position being movable radially of the rim between a rim-engaging position and a retracted position, and means resiliently biasing the arm lip toward its rim-engaging position so as to cause the arm lip to engage the rim with a force dependent on and limited by the strength of the biasing means.

11. Mechanism as in claim 10 in which the arm lip is fixed on the locking arm and such locking arm is pivoted on the attachment body and is movable radially of its pivot to carry the arm lip between its rim-engaging and retracted positions, and said lip biasing means comprises a spring acting to urge the arm toward its pivot.

12. Mechanism as in claim 11 in which the locking arm in its retracted position locates the arm lip at a distance less than the diameter of the container rim from an opposite end portion of the body lip means so as to define therewith a restricted entrance for movement of the container rim into engagement with the body lip means, the arm lip in such location being resiliently retractable to permit a container rim to be manually moved past dead center through such restricted entrance into engagement with the body lip means and being operative thereafter to hold the rim in such engagement.

13. Mechanism for attaching a valve assembly to the neck of a container having a circular peripheral rim, comprising an attachment body having means for supporting said valve assembly for the container, lip means on said body for engaging the container rim at a plurality of points over an arc of less than 180° for positioning the body on the neck, a locking arm pivoted on said body and carrying a lip movable with the arm and substantially in the plane of the body lip means between a retracted position for permitting a container rim to be moved into engagement with the body lip means, and a locking position opposite the body lip means for locking the body to the container, said arm lip being movable radially of the arm pivot between an inward position and an outward position, means resiliently biasing the arm lip toward its inward position, said arm having a normal position in which it locates the arm lip at a distance less than the diameter of the container rim from an opposite end portion of the body lip means so as to define therewith a restricted entrance for movement of the container rim into engagement with the body lip means, the arm lip in such location being resiliently retractable to permit a container rim to be manually moved past dead center through such restricted entrance into engagement with the body lip means and being operative thereafter to hold the rim in such engagement, and said arm being movable from said normal position to a locking position opposite a mid-portion of the body lip means for locking the container rim to the attachment body.

* * * * *